United States Patent [19]

Freller

[11] 4,351,135

[45] Sep. 28, 1982

[54] LENGTH-ADJUSTABLE STRUCTURAL UNIT

[76] Inventor: Walter Freller, Wallernstrasse 20, A-4522 Sierning, Austria

[21] Appl. No.: 162,622

[22] Filed: Jun. 24, 1980

[30] Foreign Application Priority Data

Jun. 29, 1979 [AT] Austria ..... 4591/79

[51] Int. Cl.[3] ..... E04B 1/343

[52] U.S. Cl. ..... 52/67; 52/66; 52/118

[58] Field of Search ..... 52/67, 66, 118

[56] References Cited

U.S. PATENT DOCUMENTS

| | | | |
|---|---|---|---|
| 2,804,949 | 9/1957 | Woolslayer et al. | 52/118 |
| 3,341,986 | 9/1967 | Brosig | 52/67 |
| 3,745,725 | 7/1973 | Boucaud | 52/67 |
| 4,103,462 | 8/1978 | Freller | 52/67 |
| 4,277,919 | 7/1981 | Artweger et al. | 52/67 |

*Primary Examiner*—Alfred C. Perham

*Attorney, Agent, or Firm*—Silverman, Cass & Singer, Ltd.

[57] ABSTRACT

An arrangement of tensile elements and rollers provides support for an extensible part against forces occurring in two directions perpendicular to the extension direction in which the extensible part is carried by a carrying part of conforming geometry. Two wire ropes form the tensile elements. First ends of each rope are attached to the top corners of one end of the carrying part and second ends of each rope are attached to the opposite bottom corners of the other end of the carrying part. The ropes extend in the extension direction from their carrying part attachments to the extensible part. At the extensible part, the ropes are passed over pulleys in two directions substantially transverse of the extension direction.

3 Claims, 1 Drawing Figure

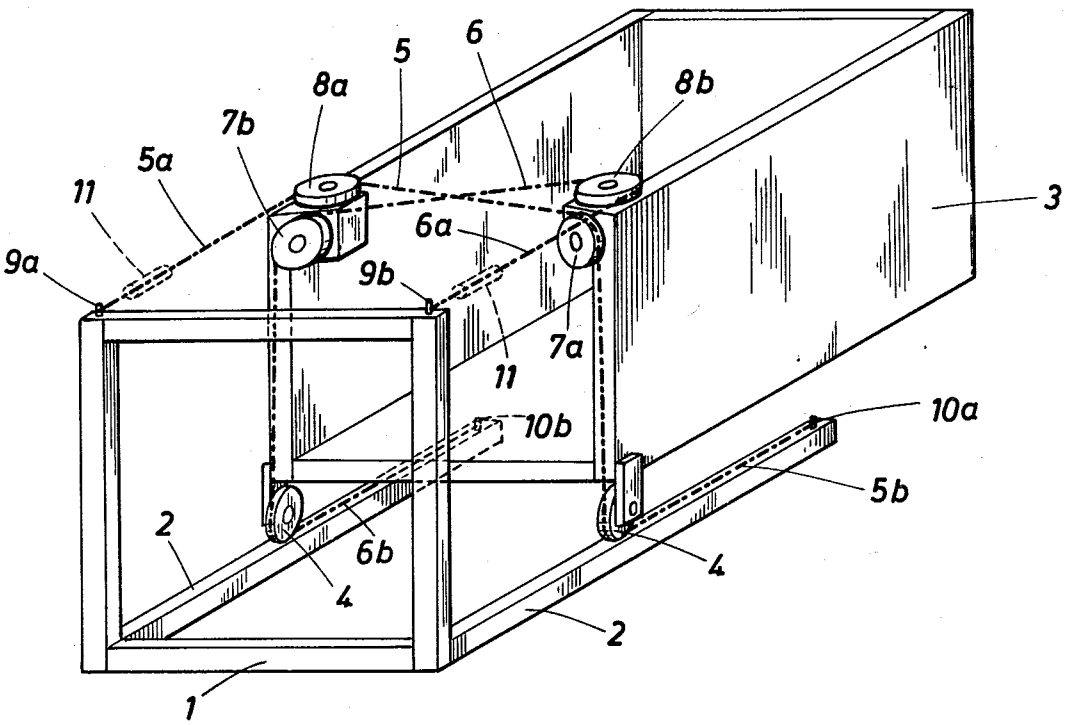
3
8b
6
5
8a
7b
5a
11
9a
6a
7a
9b
11
10a
10b
5b
4
2
6b
4
2
1

LENGTH-ADJUSTABLE STRUCTURAL UNIT

BACKGROUND OF THE INVENTION

This invention relates to a length-adjustable structural unit, which comprises a carrying part having a bearing surface, an extension part which is extensible on said bearing surface, and constraining means for preventing a tilting of the extension part even when it is extended. The constraining means comprise two flexible tensile elements that are disposed on opposite sides of the extension part. Each of said tensible elements are held in tension between the two ends of the bearing surface of the carrying part and are trained around at least two deflecting rollers, which are mounted on the extension part and are spaced apart at right angles to the bearing surface. The courses of the tension elements are disposed between the points where they are supported on the carrying part and those deflecting rollers which are nearest to said supporting points along the respective tensile element in a direction substantially parallel to the direction in which the extension part is extensible.

Structural units having a carrying part and an extension part, which is extensible from said carrying part, can be used for various purposes. The extension part may be used as a drawer or, for instance, as a slipform for use in bridge building or as an extensible crane boom. Length-adjustable structural units may be used also as shipping containers, slidable roofs or length-adjustable vehicles. It is desired within the scope of the invention to provide a structural unit which comprises a carrying part and an extension part which can be extended out of the carrying part and is guided in such a manner that forces acting transversely to the direction in which the extension part is extensible can be transmitted with simple means from the extension part to the carrying part.

To provide an arrangement comprising a carrying part and an extension part, which can be extended to a large extent out of the carrying part, it is known to guide the extension part on a bearing surface consisting, e.g., of two lateral rails and to provide the carrying portion with two tensioned ropes which extend along the bearing surface and in Z-shaped configurations are trained around two pulleys, which are mounted in the extension part. The load which is due to the weight of the extension part and tends to tilt the latter acts in the two lateral rope poritons in a sense tending to increase the size of the Z-shaped loop formed by the two ropes so that these two ropes can be stressed only in tension by the extension part. Because the loop length is predetermined by the lengths of the ropes, the Z-shaped loop formed by the ropes cannot increase so that a tilting of the extension part is automatically prevented. That arrangement which is used mainly for drawers has the disadvantage that the extension part is held only against tilting caused by a load which is due to a weight but is not held against a lateral displacement or canting under the action of lateral forces which may be due, e.g., to a wind load.

For this reason it is an object of the invention so to improve a structural unit of the kind described first hereinbefore that the extension part is held not only against vertical tilting, but a simple transmission of lateral forces acting on the extension part to the carrying part, is also ensured.

This object is accomplished according to the invention in that at least two of the deflecting rollers around which each tensile element is trained are spaced apart in a direction which is parallel to the bearing surface of the extension part and transverse to the direction in which the extension part is extensible.

Because each of the two tensile elements is trained around pulleys which are spaced apart at right angles to the bearing surface of the extension part and parallel to that surface, the loop formed by each tensile element has two components of action, one of which is at right angles to the bearing surface and the other of which is parallel to the bearing surface. As a result, the loop formed by each tensile element can transmit forces which act at right angles to the bearing surface of the extension part from the extension part to the carrying part, as well as forces which act parallel to the bearing surface and transversely to the direction in which the extensible part is extensible. Because such loop formed by a tensile element must be loaded only in a sense tending to increase its size, each loop can ensure a support of the extension part only to one side. For this reason, two tensile elements are required, which act in opposition to each other as regards the transmission of lateral forces.

Each tensile element has two courses, which extend from respective points where the tensile element is supported by the carrying part to the deflecting rollers which are nearest to said respective points of support along the respective tensile element. If said courses of each tensile element lie on opposite sides of the extension part, a simple arrangement can be provided in which the loop formed by each tensile element extends also parallel to the bearing surface. Such configuration of a tensile element can be obtained with a minimum number of deflecting rollers.

To permit an extension of an extension part not only along a straight line, a preferred feature of the invention resides in that at least one tensile element is adjustable in length. The path along which the extension part is extensible will automatically be given a curvature if one of the two tensile elements is shortened (or increased in length).

An embodiment of the invention is illustrated by way of example on the drawing, which is a perspective view showing a structural unit according to the invention consisting of a carrying part and an extensible extension part.

The structural unit shown on the drawing consists essentially of a carrying part 1 and an extension part 3, which is movable on a bearing surface formed by two track rails 2, which are carried by the carrying part 1. The designs of the carrying part 1 and of the extension part 3 may be selected as desired. The extension part 3 has rollers 4, which are supported on and can roll along the track rails 2 of the carrying part 1. Constraining means for the extension part 3 comprise two ropes 5 and 6. Ropes 5 and 6 extend on opposite sides of the extension part 3 and between the ends of the track rails 2 and are tensioned and trained around pulleys, which are rotatably mounted on the extension part 3. To simplify the structure as much as possible, the track rollers 4 serve also as deflecting rollers or pulleys, from which the ropes 5 and 6 extend upwardly, at right angles to the bearing surface formed by the track rails 2. The ropes 5 and 6 further extend to deflecting rollers or pulleys **7*a* and 7*b* and then to deflecting rollers or pulleys 8*a* and 8*b* disposed on the respective other sides of the extension part 3. Each of the ropes 5 and 6 is tensioned between respective points 9***a* and 10*a*, and 9*b* and 10*b* at which the rope is supported on the carrying part 1. Between the points 9*a* and 10*a*, and 9*b* and 10*b* at which each of said ropes 5 and 6 is supported on the carrying part, and the pulleys 4 and 8 which are nearest to said points of support 9*a*, 10*a*, and 9*b*, 10*b* along the respective rope, each of the ropes 5 and 6 has two courses 5*a*, 5*b* or 6*a*, 6*b*, which are parallel to the track rails 2. The two courses 5*a*, 5*b* and 6*a*, 6*b* of each of ropes 5 and 6 lie on opposite sides of the extension part 3.

In this arrangement, each rope forms a loop which, between the pulleys 4 and 7, has a portion that is at right angles to the bearing surfaces formed by the track rails 2, and between the pulleys 7 and 8 has a portion which is parallel to said bearing surface and transverse to the track rails 2. As a result, the tensioned ropes 5 and 6 can transmit from the extension part 3 to the carrying part 1 not only forces which are at right angles to the bearing surface formed by the track rails 2 but also transverse forces, which also tend to increase the loop formed by each rope. For this reason the extension part 3 cannot be tilted or canted relative to the carrying part 1 under a load which is due to its weight or under any lateral forces which may be exerted and this result is obtained regardless of the extent to which the extension part 3 has been extended. In this arrangement against tilting and canting under any forces which may be conceived, the forces which ensure this contraint will not be decreased even when the extension part 3 is extended out of the carrying part 1 to the largest extent which is permitted by the track rails 2.

The length of the ropes 5 and 6 may be adjusted by means of turnbuckles 11, which may also be used to alter the length of only one rope so that the extensible part will then be extended along a curved line.

It will be understood that the invention is not restricted to the embodiment shown by way of example. For instance, chains may be used rather than the ropes 5 and 6. Besides, the means provided on the extension part 3 to guide it in the carrying part 1 may consist of runners or a slider rather than of rollers. In that case the rollers 4 can no longer be used as pulleys. Finally, owing to the fact that the extensible part 3 is guided in two directions, namely, parallel to the bearing surface and at right angles thereto, the track rails 2 need not be horizontal. Within the scope of the invention, structural units may be conceived in which the extension part is vertically extensible although this would require an additional tensile element.

It has not been mentioned hereinbefore that for a satisfactory function of such length-adjustable structural unit a lateral displacement of the rollers 4 of the extension part 3 on the track rails 2 must be prevented. This can be accomplished by a suitable design of the track rails and/or the rollers or in that the friction between the rollers and the track rails is utilized for this purpose.

What is claimed is:

1. In a length-adjustable structural unit including a carrying part having a near end and a far end spaced apart in a first direction and a bearing surface extending in said first direction and in a second direction that is transverse to said first direction, an extension part mounted on said carrying part in contact with said bearing surface and extensible and retractable relative to said carrying part generally in said first direction, and constraining means comprises first and second tensile elements, each of which is supported by said carrying part at a first point near said near end and a second point near said far end, and a plurality of deflecting rollers, which are rotatably mounted on said extension part and around which said tensile elements are trained, said deflecting rollers for each of said tensile elements comprising first and second rollers that are nearest to said first and second points for the respective tensile elements, measured along the same, and are so designed and arranged that the respective tensile element extends substantially in said first direction from each of said first and second points to the first and second deflecting rollers, respectively at least two of said deflecting rollers for each of said tensile elements being spaced apart in a second direction, which is at right angles to said first and second directions, corresponding portions of said tensile elements extending generally in said first direction being disposed on opposite sides of said extension part, whereby said constraining means hold said extension part against tilting transversely to said first and second directions even when said extension part is extended, the improvement comprising:

third deflecting rollers around which each of said tensile elements is trained, each of said third deflecting rollers being spaced from one of said deflecting rollers for the same tensile element in a direction which is parallel to said bearing surface and transverse to said first direction, so that said constraining means are arranged to hold said extension part against canting relative to said carrying part in said second direction.

2. The improvement set forth in claim 1, in which each of said tensile elements comprises a first course from said first point to said first deflecting roller for said tensile element and a second course from said second point to said second deflecting roller for said tensile element and said first and second courses of said tensile element are disposed on opposite sides of said extension part.

3. The improvement set forth in claim 1, in which at least one of said tensile elements is provided with means for adjusting the length of said tensile element between said first and second points of support.

* * * * *